US006508160B2

(12) United States Patent
Beretta

(10) Patent No.: US 6,508,160 B2
(45) Date of Patent: Jan. 21, 2003

(54) GAS-FLOW DEVICE FOR AUTOMATIC SHOTGUNS

(75) Inventor: Ugo Gussalli Beretta, Brescia (IT)

(73) Assignee: Fabbrica D'Armi Pietro Beretta S.p.A (IT)

( * ) Notice: Subject to any disclaimer, the term of this patent is extended or adjusted under 35 U.S.C. 154(b) by 0 days.

(21) Appl. No.: 09/866,396

(22) Filed: May 25, 2001

(65) Prior Publication Data

US 2001/0054350 A1 Dec. 27, 2001

(30) Foreign Application Priority Data

Jun. 7, 2000 (IT) ..... 2000 B/42

(51) Int. Cl.[7] ..... F41A 5/18

(52) U.S. Cl. ..... 89/191.02; 89/191.01; 89/192; 89/193

(58) Field of Search ..... 89/191.01, 191.02, 89/192, 193

(56) References Cited

U.S. PATENT DOCUMENTS 3,945,296 A * 3/1976 Hyytinen ..... 89/191.02
4,174,654 A * 11/1979 Liedke ..... 89/191.02
4,324,170 A * 4/1982 Healy ..... 89/159
4,901,623 A * 2/1990 Lee ..... 89/191.02
5,429,034 A * 7/1995 Badali et al. ..... 89/191.02
5,872,323 A * 2/1999 Norton et al. ..... 89/191.02

FOREIGN PATENT DOCUMENTS

CA 723902 * 12/1965 ..... 89/193
DE 2559238 * 4/1977 ..... 89/191.02
GB 2237363 * 1/1991 ..... F41A/1/04

* cited by examiner

*Primary Examiner*—Michael J. Carone
*Assistant Examiner*—Gabriel Sukman
(74) *Attorney, Agent, or Firm*—McGlew and Tuttle, P.C.

(57) ABSTRACT

This is a gas-flow device for semiautomatic or automatic shotguns, which consists of a gas-flow cylinder, closed at the front part by a flange with gas discharge ports (17) around the ammunition magazine, opposite the cylinder, a circular valve (18) that moves axially for controlled opening and closing of the discharge ports. The valve is kept in the closed position by a pre-stressed spring (19) and it moves to the open position when the gas pressure in the expansion chamber increases beyond a set value.

15 Claims, 2 Drawing Sheets

GAS-FLOW DEVICE FOR AUTOMATIC SHOTGUNS

FIELD OF THE INVENTION

This invention concerns, in general, the sector of semi-automatic and automatic shotguns with the so-called "gas-flow" operation, and, in particular, those guns furnished for purposes of functionality, reliability and durability with automatic compensation of the gas thrust on the moving parts, such as arming rods, breech-block, breech-block carriage, all intended to give the best possible constant working conditions.

Here below, reference will be made especially to smooth bore shotguns of the type used for hunting, for which the invention, although of a general nature, is primarily intended.

BACKGROUND OF THE INVENTION

Automatic or semiautomatic shotguns with a gas-flow device already exist. It should be noted that a semiautomatic shotgun with a smooth bore, in particular, can be used to shoot a very wide range of cartridges. For example, the range starts with the 12 caliber/gage, with 24 gram cartridges, typically used in clay-pigeon shooting, up to the powerful 56 gram and even 64 gram cartridges in the versions with the 3½ inch super magnum cartridge chamber. Such a wide range means a great variety of working conditions. As a result of this requirement, the "gas-flow" device of the latest versions is often equipped with a special valve, used to "paralyze" the impulse of the venting gases when firing the most powerful cartridges. This has the aim of keeping the rearming speed of the moving parts within acceptable limits and, thereby, avoids premature breakage due to the excessive strain on components. Although various types of automatic compensation valves have been developed over the years, today there is a standardization of the working principle. The compensation effect is achieved by means of venting the gas once a pressure limit inside the gas-flow cylinder has been reached; beyond this pressure, the valve, which is normally kept closed by a spring, allows a certain quantity of gas to be discharged.

The main characteristics required of a gas-flow device are:

- the performance, that is, the capacity for maintaining the shotgun working conditions as constant as possible, irrespective of the cartridge power, and ideal for carrying out the rearming and loading and for ensuring an acceptable life-span for the parts subject to mechanical stress. The valve must remain closed and hermetically sealed against leaking gas during the firing of less powerful cartridges in order to guarantee sufficient rearming speed, then open progressively as the power of the cartridge being fired increases; the seal, that is, the capacity for keeping to a minimum the passage of gases between the piston and cylinder which are vented from the barrel and necessary for the rearming of the moving parts;
- the lightness, simplicity and economy of construction;
- the reliability, intended as maintaining the calibration and, above all, as the capacity for self-cleaning of the solid residues of the gas combustion. This condition, if not obtained, may cause the devices to lose their functionality and, consequently, oblige the user to undertake frequent and costly maintenance. If this maintenance is not carried out, dangerous situations may arise due, for example, to the partial or total blockage of the venting holes, or a diminution of the duration of the various components;
- the possibility of adapting to various gun shapes, like the shape which is particularly sought after because it imposes no limits on the number of shots available, where the magazine passes inside the gas-flow cylinder and where the expansion chamber consequently assumes the characteristic ring shape.

The current state of the art is such that there is no case in which the above-mentioned characteristics, which may be referred to briefly as self-compensating gas-flow device and self-cleaning with loop magazine, are all present in the same version.

SUMMARY AND OBJECTS OF THE INVENTION

Given the above, it is the aim of this invention to supply a gas-flow device, in particular, for semiautomatic smooth bore shotguns, incorporating as far as possible the characteristics mentioned above and which can be summarized as follows:

- an optimal self-compensation to give the gun components longer life;
- a self-cleaning function for the compensation valve and the piston sealing elements, giving a practically maintenance-free operation, while making the device safer and more reliable at the same time; and
- a construction which is simple, light and economic in the version with the loop magazine, and, therefore, unaffected by limits of ammunition capacity.

This object and the advantages which derive from it are achieved with a gas-flow device for semiautomatic smooth-bore shotguns and a loop-type magazine in a gas-flow cylinder that has a pressure-type valve, with a ring shape, associated with the cylinder, placed around the magazine and held in a closed position by a spiral spring, suitably pre-stressed, and a valve with self-cleaning means on its rest plane.

With such a low-inertia ring valve, the gas-flow device has optimal self-compensation, given that the initial pre stressing of the spring is such as to keep the valve closed and prevent gas from being discharged from the gas-flow cylinder when firing weak cartridges, and to allow a gradual opening in proportion to the strength of the cartridges, thereby allowing a partial venting of gases at the higher pressures and maintaining the speed of the moving parts within optimal values.

The self-cleaning action is achieved by both a special shape of the valve rest/support plane, which exploits the principle of mechanical removal of the dirt after each shot, thanks to the valve motion with respect to the gas-flow cylinder due to the spring action in opening/closing the valve itself, and by self-cleaning means of the piston sealing elements, which exploit the direct action of the venting gases.

The ring shape of the compensation valve is such that it can be placed around the magazine, without interfering with the latter, either radially or lengthwise. This is a particularly valued characteristic because, apart from permitting the usual loading of an extra shot, it means that other magazine extensions may be added in the future, to give an even better capacity than the one in question. Such a set-up, therefore, makes the entire device light and simple, since it incorporates into one single mechanical part, the cylinder, all the following functions: the expansion of the gas; the sliding of the piston and the guide for the compensation valve; the attachment of the pre-stressing and gas-venting collar.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
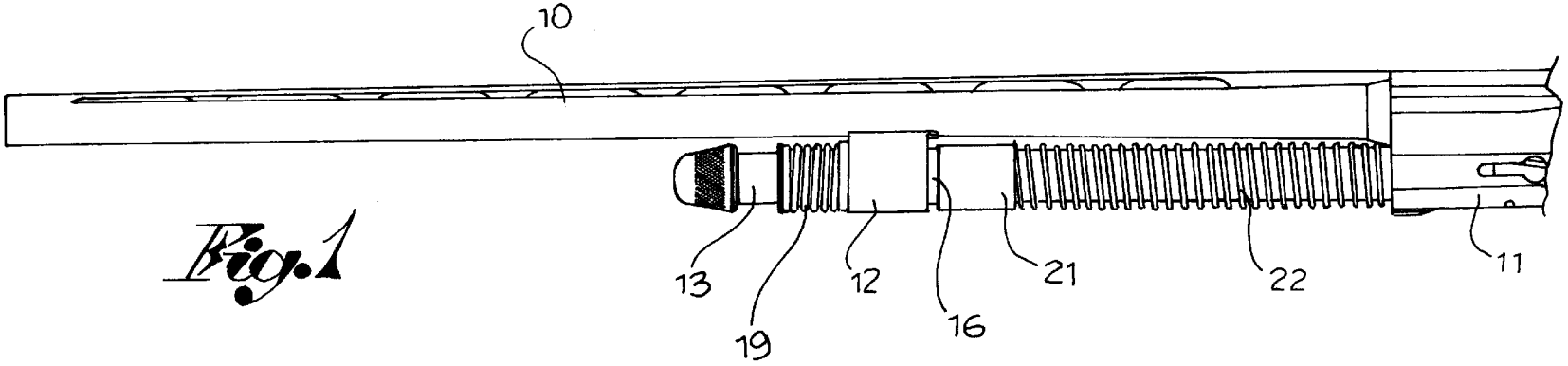
FIG. 1 is a side view showing a barrel and gas-flow device of a semiautomatic shotgun of the type used for hunting and clay pigeon shooting.
Figure 5:
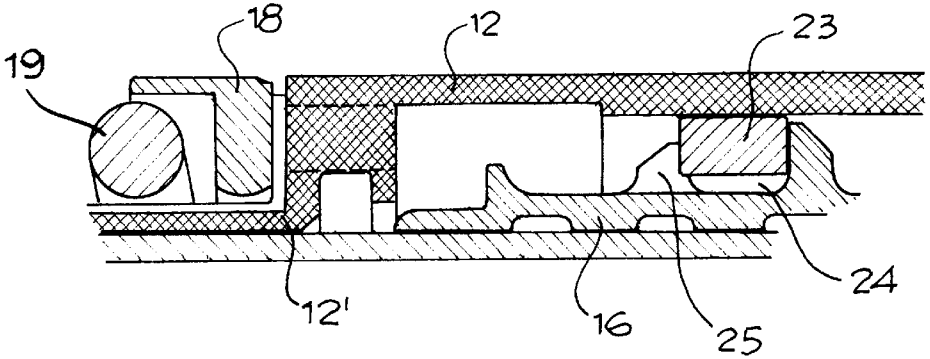
FIG. 5 is a cross-sectional view according to line D—D of FIG. 3.
Figure 2:
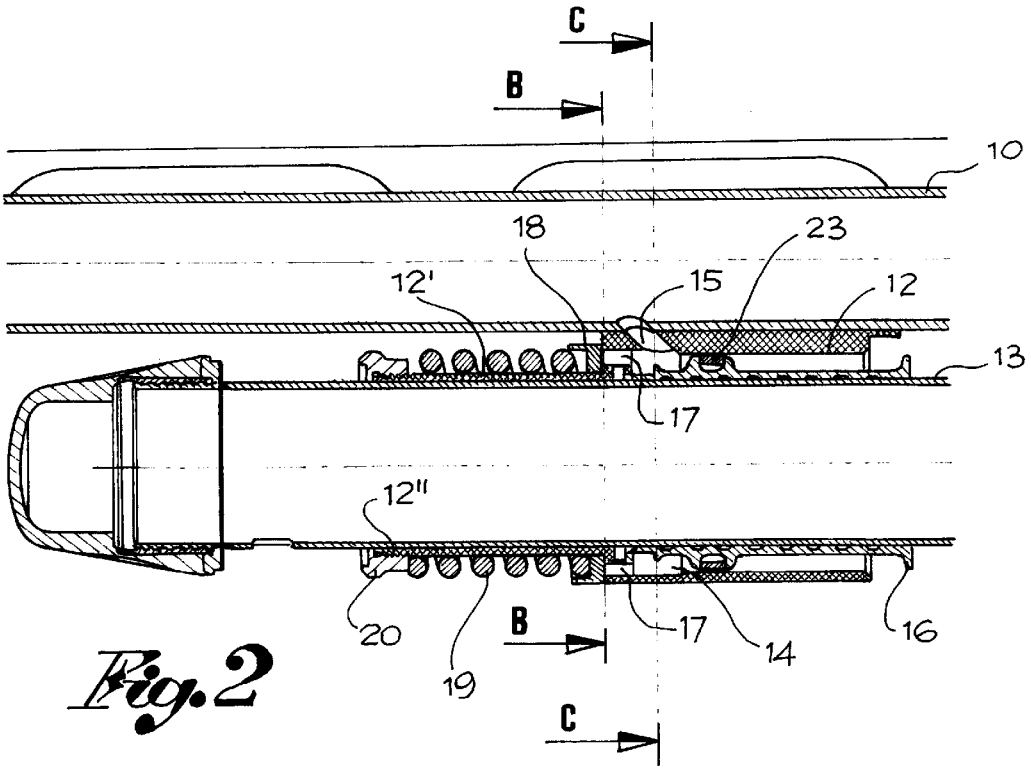
FIG. 2 is a cross-sectional view of enlarged parts of the barrel and the gas-flow device illustrated in FIG. 1.
Figure 3:
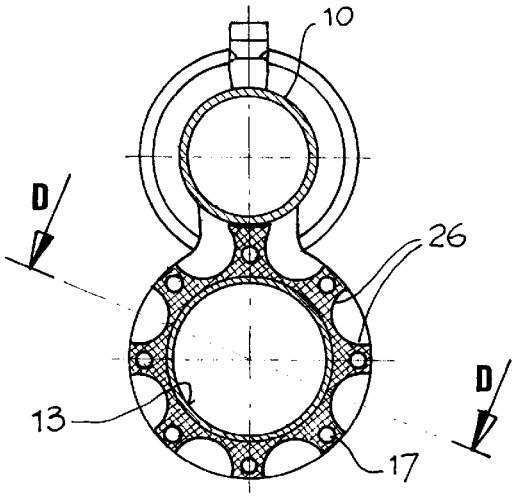
FIG. 3 is a cross-sectional view according to line B—B of FIG. 2.
Figure 4:
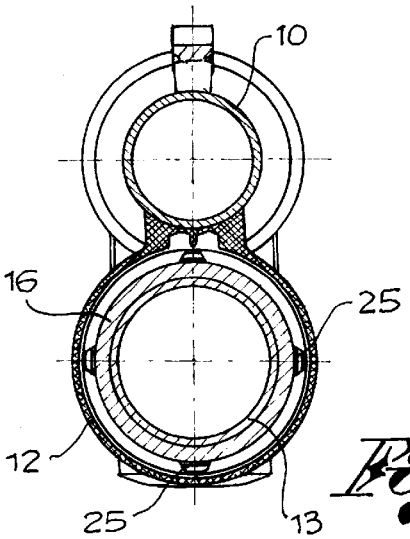
FIG. 4 is a cross-sectional view according to line C—C of FIG. 2.

Referring to the drawings in particular, a semiautomatic shotgun design is shown having a gas flow device. The shotgun is particularly for hunting/clay pigeon shooting. A barrel 10 is represented with its respective breech 11. In an intermediate part of the barrel a gas-flow cylinder 12 is fixed, crossed co-axially by a tubular-shaped magazine 13, supported at the rear by the the breech 11 of the barrel and extending forward towards the muzzle. The cylinder 12 and the magazine 13 define between them a gas expansion chamber 14, which is substantially ring-shaped, which communicates with the inside of the barrel through at least one opening for venting the gas 15. In the chamber 14, a piston 16 slides between a forward and backward position. The piston 16 is driven along the tubular magazine 13, around the tubular magazine 13, and is sealed inside the cylinder 12.

On a front part, or rather facing forwards, the cylinder 12 is closed by a flange with gas discharge ports 17 and extends as a collar section 12'. The collar section 12' surrounds the tubular magazine 13 and has a diameter inferior to that of the circumference on which the ports 17 are set. The collar section 12' has a threaded section 12".

On the collar section 12', in front of the piston, a ring shaped compensation valve 18 is mounted and guided axially, functioning essentially as a valve breech-block, intended to open and close the gas discharge ports 17 according to the gas pressure in the expansion chamber 14. The valve 18 is pushed and normally kept in the closed position for the gas discharge ports 17 by means of a spiral cylindrical spring 19, which is pre-stressed by means of a collar 20 screwed onto the threaded part 12" of the sleeve part 12' that extends from the cylinder. The spring 19 is pre-stressed in such a way as to guarantee the closure and freedom from venting through the gas discharge ports 17 when low power cartridges are fired, and to give a progressive valve opening, allowing the gases to escape from the appropriate ports when medium and high power cartridges are used, in this way "paralyzing" (damping) the pressure impact of the gases on the piston 16.

The piston 16 is moved from its forward position to a drawn back position by the pressure of the gases coming from the barrel, through the vent opening 15. As it draws back, the piston 16 acts against a sleeve 21 and, via this, upon the moving parts in order to permit rearming of the parts and the loading of a new shot, according to the usual procedure. The piston 16 is maintained in the forward position by a return spring 22 associated with the sleeve 21.

The piston 16 is furnished with special sealing devices, such as an elastic band 23, with the purpose of preventing gas leaks from the expansion chamber 14. The devices are contained within a housing, or hollow 24, this hollow 24 being open in the direction from which the gas originates in order to create a self-cleaning function for the hollow itself due to the direct action of the hot gases arriving from the gas-flow opening 15, associated with the rotation of the piston around the tubular magazine after every shot. The hollow has a certain number of teeth 25, no less than two, with the task of drawing the elastic band into position and keeping it there.

There are also self-cleaning devices for the compensation valve 18, made as semicircular recesses 26. These have a sharp edge on the support plane of the valve in such a way that, on account of the angular movement of the valve with respect to the cylinder, due to the spring action when opening and closing the valve itself, there is a mechanical action that removes the solid residues of the gases from the plane of the valve seal.

While a specific embodiment of the invention has been shown and described in detail to illustrate the application of the principles of the invention, it will be understood that the invention may be embodied otherwise without departing from such principles.

What is claimed is:

1. A gas-flow device for a shotgun with semiautomatic or automatic loading, having a barrel, a cylinder fixed to said barrel, a tubular magazine for ammunition passing co-axially through the cylinder, the gas flow device comprising:

a ring chamber for gas expansion, said ring chamber being disposed between the tubular magazine and the cylinder and communicating with an inside of the barrel via at least one opening, for gas venting;

a sliding piston seated inside said gas expansion chamber between an inactive forward position and an active backward position;

a return spring for maintaining said sliding piston in said forward position, the sliding piston moving to the backward position by gas pressure of gases coming from the inside of the barrel via said vent opening, whereby movement of the sliding piston acts to rearm and load the shotgun;

a flange closing a front part of the cylinder, said flange having a discharge port, said flange includes protrusions forming said discharge port into discharge ports with sharp edges;

a circular valve mounted around the ammunition magazine opposite the cylinder, said circular valve being axially movable for controlled opening and closing of said discharge port, said sharp edges of said flange self-cleaning surfaces on said circular valve; and a pre-stressed return spring for maintaining said circular valve in a closed position, said circular valve moving to the open position as a result of gas pressure in said expansion chamber rising beyond a set value.

2. A gas-flow device according to claim 1, further comprising a sleeve portion extending forwards around said tubular magazine for ammunition, said circular valve and said pre-stressed spring being placed around said sleeve portion, a pre-stress level of said pre-stressed spring being set in the factory with a collar screwed around the sleeve portion.

3. A gas-flow device according to claim 1, wherein said sliding piston has at least one hollow situated radially, said hollow containing an elastic band for sealing with internal surfaces of the cylinder, said band being held between shoulders on said sliding piston, said hollow being open on a side exposed to gases originating from said barrel with at least one opening for gas venting.

4. A shotgun with gas-flow device for semiautomatic or automatic loading, the shotgun comprising:

a barrel with at least one opening for gas venting;

a cylinder having an inner surface fixed to said barrel;

a tubular magazine for ammunition passing co-axially through said cylinder;

a ring chamber for gas expansion, said ring chamber being disposed between the tubular magazine and the cylinder and communicating with an inside of the barrel via at least one opening for gas venting;

a sliding piston seated inside said gas expansion chamber between an inactive forward position and an active backward position;

a return spring for maintaining said sliding piston in said forward position, the sliding piston moving to the backward position by gas pressure of gases coming from the inside of the barrel via said opening for gas venting, whereby movement of the sliding piston acts to rearm and load the shotgun;

a flange closing a front part of the cylinder, said flange having a discharge port, said flange including protrusions forming said discharge port into discharge ports with sharp edges;

a circular valve mounted around the ammunition magazine opposite the cylinder, said circular valve being axially movable for controlled opening and closing of said discharge port, said sharp edges of said flange self-cleaning surfaces on said circular valve; and a pre-stressed spring for maintaining said circular valve in a closed position, said circular valve moving to the open position as a result of gas pressure in said expansion chamber rising beyond a set value.

5. A shotgun according to claim 4, further comprising a sleeve portion extending forwards around said tubular magazine for ammunition, said circular valve and said pre-stressed spring being placed around said sleeve portion, a pre-stress level of said pre-stressed spring being set in the factory with a collar screwed around the sleeve portion.

6. A shotgun according to claim 4 wherein said sliding piston has at least one hollow situated radially, said hollow containing an elastic band for sealing with internal surfaces of the cylinder, said band being held between shoulders on said sliding piston, said hollow being open on a side exposed to gases originating from said barrel with at least one opening for gas venting.

7. A shotgun comprising a gas-flow device for semiautomatic or automatic loading according to claim 1, in which said cylinder has a sleeve portion extending forwards around said tubular magazine for ammunition, said circular valve and said return spring being placed around said sleeve, said pre-stressed level of said return spring being set in the factory with a collar screwed around said sleeve.

8. A device in accordance with claim 4, wherein:

said pre-stressed spring angularly moves said circular valve during axial movement of said circular valve.

9. A device in accordance with claim 4, wherein:

said pre-stressed spring angularly moves said circular valve during opening and closing of said discharge port.

10. A shotgun in accordance with claim 1, wherein:

said pre-stressed spring angularly moves said circular valve during axial movement of said circular valve.

11. A shotgun in accordance with claim 1, wherein:

said pre-stressed spring angularly moves said circular valve during opening and closing of said discharge port.

12. A firearm comprising:

a barrel defining a opening for gas venting;

a cylinder fixed to said barrel, said cylinder having an internal surface;

a tubular magazine for ammunition passing co-axially through said cylinder;

a ring chamber for gas expansion, said ring chamber being disposed between said tubular magazine and said cylinder and communicating with an inside of said barrel via said opening for gas venting;

a sliding piston seated inside said ring chamber and movable between a first position and a second position, said sliding piston defining a hollow arranged radially around said sliding piston, said hollow being open on a side exposed to gases originating from said opening of said barrel;

an elastic band arranged in said hollow of said sliding piston and for sealing with said internal surface of said cylinder;

a piston spring for maintaining said sliding piston in said first position, said sliding piston moving to said second position by a pressure of gases coming from said barrel via said opening for gas venting;

a breech connected to said barrel and said magazine, said breech including a rearming device connected to said sliding piston, said rearming device rearming the firearm by movement of said sliding piston;

a flange closing a front part of said cylinder, said flange defining a discharge port;

a circular valve mounted around said magazine and arranged adjacent said flange, said circular valve being axially movable toward and away from said flange;

a valve spring for biasing said circular valve against said flange, said circular valve moving away from said flange as a result of gas pressure in said ring chamber rising beyond a set value.

13. A firearm in accordance with claim 12, wherein:

said flange includes protrusions forming sharp edges;

said circular valve is angularly movable with respect to said cylinder for self-cleaning of sources on said circular valve with said sharp edges of said flange.

14. A firearm in accordance with claim 13, wherein:

said valve spring angularly moves said circular valve during axial movement of said circular valve.

15. A fire in accordance with claim 13, wherein:

said valve spring angularly moves said circular valve during opening and closing of said discharge port.

* * * * *